US010731339B2

(12) United States Patent
Hauserman-Winder et al.

(10) Patent No.: US 10,731,339 B2
(45) Date of Patent: Aug. 4, 2020

(54) MODULAR AND REUSABLE TEMPORARY CONSTRUCTION WALL

(71) Applicant: AECEMI, LLC, New York, NY (US)

(72) Inventors: Patricia Hauserman-Winder, Dobbs Ferry, NJ (US); Salvatore F. Falciglia, III, Midland Park, NJ (US); Matthew Eugene Gindlesparger, Philadelphi, PA (US); Maurice Michael Astorga, Marietta, GA (US); Andrew Campbell, Jersey City, NJ (US); Heiko Sieling, Jersey City, NJ (US); Pawel Nawrocki, Bayonne, NJ (US); Jamie Kyle Hicks, Charlotte, NC (US); Calvin Domenico, Sarasota, FL (US)

(73) Assignee: AECEMI, LLC, New York, NY (US)

( * ) Notice: Subject to any disclaimer, the term of this patent is extended or adjusted under 35 U.S.C. 154(b) by 0 days.

(21) Appl. No.: 16/308,301

(22) PCT Filed: Jun. 8, 2017

(86) PCT No.: PCT/US2017/036531
§ 371 (c)(1),
(2) Date: Dec. 7, 2018

(87) PCT Pub. No.: WO2017/214382
PCT Pub. Date: Dec. 14, 2017

(65) Prior Publication Data

US 2019/0186129 A1 Jun. 20, 2019

Related U.S. Application Data

(60) Provisional application No. 62/348,110, filed on Jun. 9, 2016.

(51) Int. Cl.
*E04B 2/74* (2006.01)
*E04G 21/28* (2006.01)
(Continued)

(52) U.S. Cl.
CPC ..... *E04B 2/7403* (2013.01); *E04B 1/74* (2013.01); *E04B 1/942* (2013.01); *E04B 2/721* (2013.01);
(Continued)

(58) Field of Classification Search
CPC ..... E04B 2/7403; E04B 2/721; E04B 1/942; E04B 1/74; E04B 2/7453;
(Continued)

(56) References Cited

U.S. PATENT DOCUMENTS 4,667,450 A * 5/1987 Stefnik ..... E04B 2/7409 52/238.1
5,067,543 A 11/1991 Bove
(Continued)

FOREIGN PATENT DOCUMENTS

CA 1 209 776 A 8/1986
EP 0950604 A2 * 10/1999 ..... B63B 3/68
(Continued)

OTHER PUBLICATIONS

International Search Report dated Aug. 30, 2017, issued in PCT Application No. PCT/US2017/036531, 3 pages.

*Primary Examiner* — Patrick J Maestri
(74) *Attorney, Agent, or Firm* — Knobbe, Martens, Olson & Bear LLP

(57) ABSTRACT

A modular, reusable temporary enclosure system is particularly suited for the renovation of buildings having stacked concrete floors supported by steel and/or concrete columns. The system consists of a set of track components, one fastened to the floor, and one fastened to the ceiling. Columns assembled from rigid panels are supported and aligned between these components. The panel edges are connected to one another by an interfacing spline assembly. To ensure that the components can be brought up to the
(Continued)

construction site by elevator, individual panels are shorter than the full distance between the floors.

13 Claims, 20 Drawing Sheets

(51) Int. Cl.

| | |
|---|---|
| ***E04G 21/24*** | (2006.01) |
| ***E04B 1/74*** | (2006.01) |
| ***E04B 1/94*** | (2006.01) |
| ***E04B 2/72*** | (2006.01) |
| ***E04G 21/14*** | (2006.01) |
| *E04B 1/61* | (2006.01) |
| *E04G 21/30* | (2006.01) |
| *E04B 2/78* | (2006.01) |
| *E04B 2/82* | (2006.01) |

(52) U.S. Cl.
CPC ..... *E04B 2/7453* (2013.01); *E04G 21/14* (2013.01); *E04G 21/243* (2013.01); *E04G 21/28* (2013.01); *E04B 1/6154* (2013.01); *E04B 2/7409* (2013.01); *E04B 2/7863* (2013.01); *E04B 2/82* (2013.01); *E04B 2001/6195* (2013.01); *E04B 2001/742* (2013.01); *E04G 21/30* (2013.01)

(58) Field of Classification Search
CPC ..... E04B 2001/742; E04B 1/6154; E04B 2001/6195; E04B 2/82; E04B 2/7863; E04B 2/7409; E04G 21/14; E04G 21/243; E04G 2001/742
See application file for complete search history.

(56) References Cited

U.S. PATENT DOCUMENTS

| | | | | |
|---|---|---|---|---|
| 5,701,708 | A * | 12/1997 | Taraba | E04B 1/14 52/210 |
| 5,992,109 | A | 11/1999 | Jonker | |
| 2009/0133354 | A1 * | 5/2009 | Spear | E04B 2/7453 52/588.1 |

FOREIGN PATENT DOCUMENTS

| | | |
|---|---|---|
| NL | 7115856 | 6/1972 |
| WO | WO 2008/113886 A2 | 9/2008 |

* cited by examiner

MODULAR AND REUSABLE TEMPORARY CONSTRUCTION WALL

CROSS-REFERENCE TO PRIOR APPLICATIONS

The present application is based on and claims the benefit and priority of U.S. Provisional Patent Application No. 62/348,110, titled "Modular and Reusable Temporary Construction Wall," filed on 9 Jun. 2016.

U.S. GOVERNMENT SUPPORT

Not applicable

BACKGROUND OF THE INVENTION

Area of the Art

The present invention is in the art of building construction and more specifically is directed to a modular temporary wall system for use in building construction and renovation.

Description of the Background of the Invention

Renovation of buildings, particularly within a dense urban environment, can pose many significant challenges. Many modern buildings consist of floors, often of reinforced concrete supported by concrete and/or steel posts and frequently concrete frame or concrete on metal deck on structural frame. The basic structure provides shafts for elevators and utilities. The building is finished by adding a building enclosure system—exterior walls/windows—plus interior partition walls and interior floor coverings. Often the interior walls are merely partitions and do not contribute structurally.

The basic structure of the building often outlives the utility of the interior walls and finishes and even that of the building enclosure system. Therefore, there is a considerable industry based around renovating structures to replace outlived components, thereby gaining additional useful life for the core building. Conceptually, this consists of stripping off the building enclosure system and replacing interior partitions and finishes, i.e., walls, floor covering, fixtures, etc. However, going from concept to practice is often difficult, particularly with regard to exterior façade and window replacements. Once the exterior is removed from a building, the structure becomes essentially uninhabitable rendering the interior space unusable until the renovation is complete. Furthermore, in many parts of the world, even if the building can be completely vacated during renovation, the interior spaces may be uninhabitable for the construction workers during significant portions of the year (too hot or too cold). Therefore, it is usual practice to erect some sort of temporary enclosure around the building core. This covering keeps the worst of the elements out of the interior allowing exterior component construction workers to do their jobs. Further, such covering keep interior construction workers from falling from the building and from dropping tools and debris on the surrounding neighborhood.

Unfortunately, temporary enclosures used to date are at best a stop-gap undertaking. They often consist of a mish-mash of plastic, plywood and similar material. They are slow to erect, ugly to behold and produce a huge amount of waste material when they are finally torn down at the end of the renovation. What is needed is an enclosure system that is easy to erect and easy to remove at the completion of construction, and, moreover, a system wherein the components can largely be reused for the next construction project.

SUMMARY OF THE INVENTION

The present invention solves these problems in the renovation of buildings that consist of stacked concrete floors supported by steel and/or concrete columns (or similar structures) although it is also adaptable to large low rise or even single story structures. The invention provides a simple modular panel system with expandable components that allow rapid assembly of the system wherever a temporary enclosure is needed. This solution can be used either around all or part of the external periphery of a building undergoing renovation, or even internally to partition an area undergoing renovation from an occupied area not yet or already renovated.

The system consists of a set of tracks. A base track is fastened to the floor, and a channel-like top track is fastened to the ceiling directly above the base track at the location of the desired wall. The top track is fastened to the lower surface of the floor above and clamps a plurality of panel columns assembled from rigid panels. The horizontal base track is attached to the floor and aligns the rigid panel columns that are clamped by the top track. The panel edges are connected to one another with an interfacing spline assembly. To ensure that the components can be brought up to the construction site by elevator, panels are generally shorter than the full distance between the floors. Therefore, multiple panels are assembled to form a panel column that spans from floor to ceiling. The top track with a range of adjustable depth receives panels with enough clearance to allow fitting of panels to spline assemblies while providing adequate support and load resistance.

Once the track assemblies are erected, fire and/or weatherproof insulating panels are installed into the track and interfacing with each other by means of splines to create the wall section. The panels can be easily cut so that existing utilities can pass through. Panels can be prepared with doors and other opening pre-installed. At the end of renovation, the panels are easily removed, the tracks removed and largely reused for other construction areas. Even the majority of the panels are readily reused with the exception of those that have been cut to allow the passage of utilities since the arrangement of pipes and conduits inevitably varies from building to building. Some components that are strongly fastened to the concrete may be left in place.

Important features of the invention include: 1) it is demountable allowing efficient re-use of as much as 50%-70% of the material or more; 2) typical 12 foot-16 foot (365.76 cm to 487.68 cm) floor to floor heights are readily accommodated; 3) typical installation between 5 feet (152.4 cm) and 10 feet (304.8 cm) from exterior (open) edge of the floor; 4) it resists lateral shear loads, but has no vertical load bearing capacity beyond its dead load; 5) the system accommodates a maximum deflection of approximately 2.5 inches (6.35 cm) due to wind stress, etc.; 6) it avoids the use of mechanical fasteners to connect panels because fasteners require significant labor to install and remove and can be lost during relocation/ruse; 7) the system readily provides a person door for daily access of workers & materials; 8) all components can be delivered by interior elevator because the maximum panel length adopted is 8 feet (243.84 cm); 9) the system is entirely water tight, thermally insulated and acoustically insulated; 10) it has a flush profile on both sides with a maximum protrusion=½ inch-¾ inch (1.27-1.905 cm); 11) the system is aesthetically pleasing inside and out;

12) system is easily erected by small work force and uses a minimal number of different components.

The system is strong and fire resistant. The tracks as well as adjustable clamping corners are advantageously steel, fire resistant pultruded fiber glass or other suitable plastic composite. The panels are covered with fire resistant pultruded fiber glass or other suitable plastic composite materials. Other assembly components can advantageously be formed from fire resistant pultruded fiberglass or other suitable plastic composite materials.

DESCRIPTION OF THE FIGURES

In the interest of enabling one of skill in the art to practice the invention, exemplary embodiments are shown wherein like reference signs refer to like structures. For clarity, details that would be apparent to skill in the art without undue experimentation are generally omitted for clarity.

FIG. 2 shows cross-sections of splines of the invention where

FIG. 5 shows cross-sections through different embodiments of the panel edge profile where

FIG. 7 shows diagrammatic views of the top track where FIG. 7A-1 shows a width view to illustrate anchor bolt holes (FIG. 7A-2 shows a close-up of the bolt hole) and FIG. 7B-1 shows a side view of the top track to illustrate adjustment and clamping slot spacing (7B-2 shows a close-up of the adjustment slot);

FIG. 9 shows diagrammatic views of the bottom track where

FIG. 11 shows diagrammatic perspective views of the adjustable end wall track where

FIG. 20 shows perspective diagrammatic views of the components of an adjustable corner column assembly where

FIG. 28A shows the head of the cam; FIGS. 28B and 28C show longitudinal views of the locking cam in different rotational configurations; and FIG. 28D shows the locking cam in a perspective view.

DETAILED DESCRIPTION OF THE INVENTION

The following description is provided to enable any person skilled in the art to make and use the invention and sets forth the best modes contemplated by the inventors of carrying out his invention. Various modifications, however, will remain readily apparent to those skilled in the art, since the general principles of the present invention have been defined herein specifically to provide an easily assembled and easily removed reusable temporary construction wall.

Figure 1:
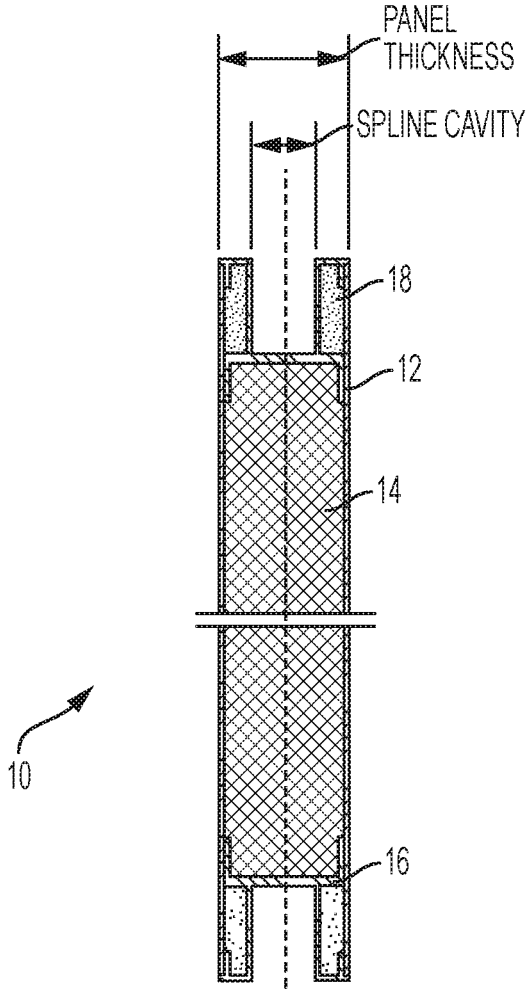
FIG. 1 is a diagrammatic cross-section of a panel (column component) of the present invention.

The basic unit of wall construction used in the current invention is a panel unit shown in cross-section in FIG. 1. The wall panel 10 is a sandwich between two pultruded fire resistant fiberglass (FG) skins or facers 12 and a core sheet of high density mineral wool insulation 14. All four edges of the panel are closed by pultruded FG panel frames 16 into which magnesium oxide cement board (MGO) edge pieces 18 are bonded. The pultruded components consist of fire resistant resin FG composite which has inherent fire resistance. Mineral wool is an extremely fire resistant insulating component, and MGO is extremely fire resistant as well as being very strong. Thus a wall assembled from panels 10, is fire resistant and durable, as well as highly insulating. The MGO pieces 18 provide fire resistant strength to a spline cavity 20 that extends all around the periphery of the panel 10.

Figure 2A:
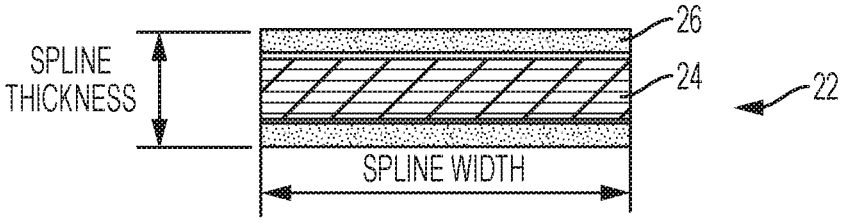
FIG. 2A shows a plywood-based spline and FIG. 2B shows a pultruded fiberglass-based spline.
Figure 2B:
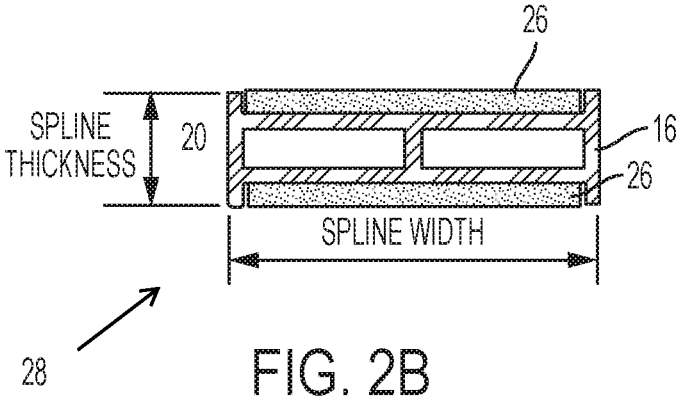
Figures 1, 7A:
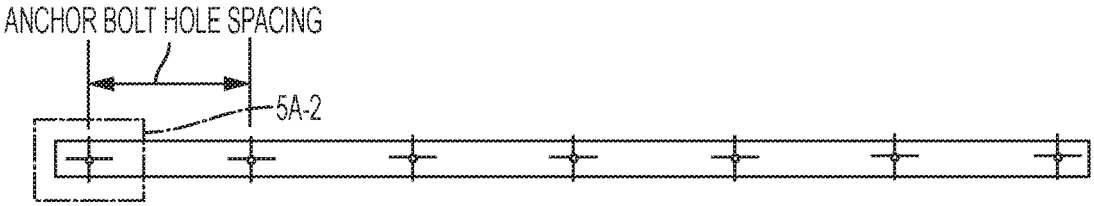
Figures 1, 7B:
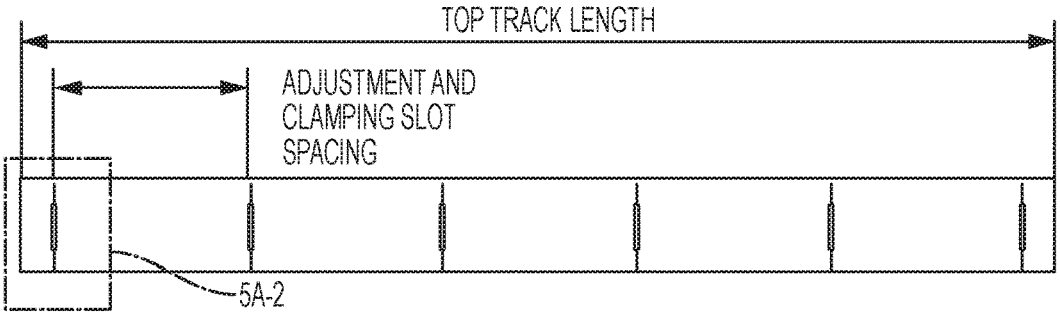
Figures 2, 7A:
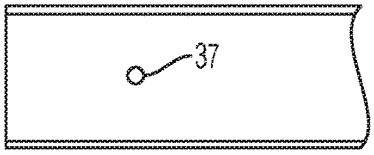
Figures 2, 7B:
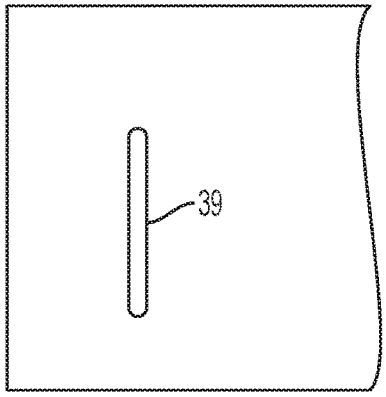

FIG. 2 shows two different versions of splines that are sized to fit within and span the spline cavities 20 of two adjacent panels 20, thereby joining the panels. FIG. 2A shows a spline 22 which has a plywood core 24 and is faced with MGO facing 26 which is bonded to the plywood with an appropriate adhesive and mechanical fasteners as necessary. The plywood core 24 is light as well as strong and heat resistant. FIG. 2B shows an alternate spline embodiment 28 where the spline body is formed from fire resistant pultruded FG which is faced with a replaceable MGO facer 26. The thickness of the splines 22, 28 is essentially the same thickness of the panel spline cavity 20 and the width of the spline is essentially equal to twice the depth of the panel spline cavity 20.

Figure 3:
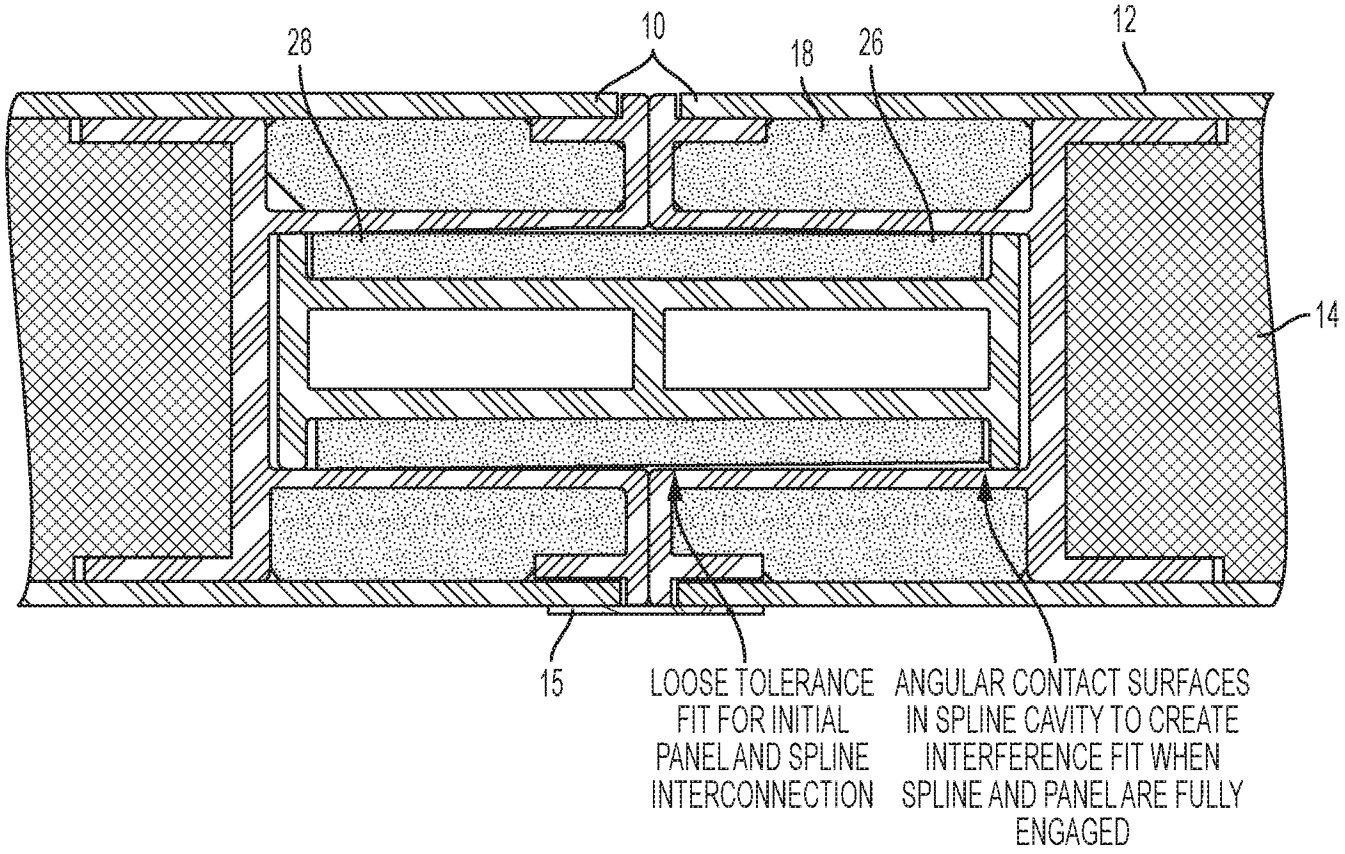
FIG. 3 is a diagrammatic cross-section through a junction between two panels showing how the spline functions.

FIG. 3 shows the junction between two panels 10 with an FG spline 28 bridging the two panels. The drawing shows that the spline cavities 20 are slightly wider at their top ends than at their bottoms. Thus, there is a slightly angular contact surface between the spline MGO surface 26 and the cavity wall 30. Therefore, a spline 28 can be easily inserted into the mouth of the cavity 20 but experiences resistance as it is pushed in farther. The MGO 26 deforms slightly and creates a strong friction fit between the spline 28 and the panel 10. When the wall is disassembled at the completion of the construction project, it is possible to replace the MGO facing 26 if it is excessively deformed. This ensures a tight fit when the spline 28 is reused to assemble a new wall. Note the optional water-proof adhesive membrane 15 that can be applied over the exterior seam between panels 10. Although not shown in the drawings this type of water-proof adhesive membrane can advantageously be applied to seal any exterior seams. For example, in FIG. 6 the membrane 15 can not only be applied to the seam between the panels 10 but also the junction between the panel edge and the base track 40 as well as the seam between the top track 34 and the platform 32 and between the panel 10 and the top track 34

Figure 4:
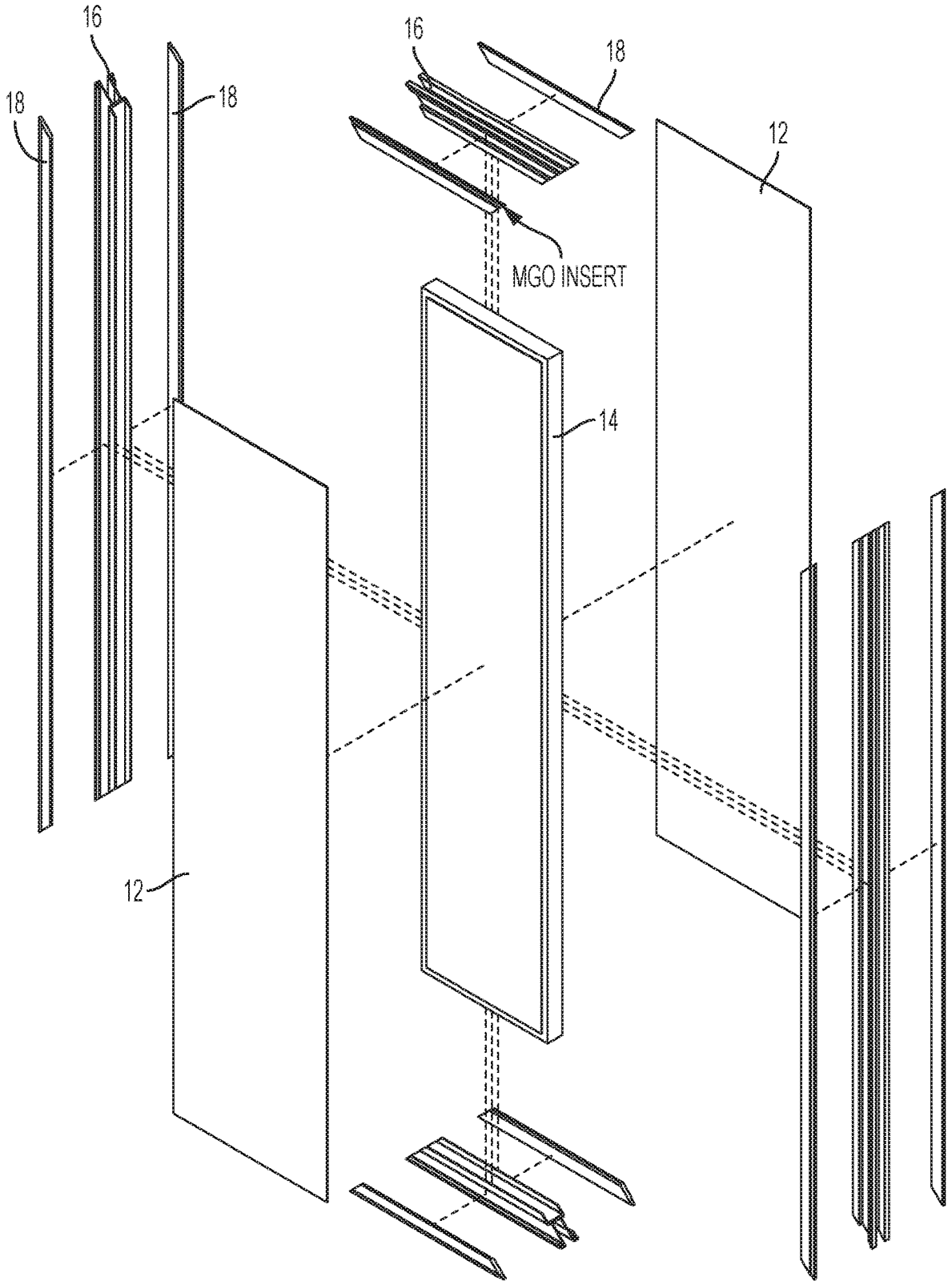
FIG. 4 shows an exploded view of a panel to explain its construction.
Figure 5A:
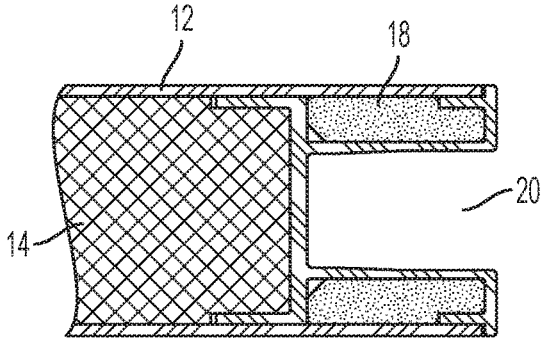
FIG. 5A shows an edge profile with drop-in MGO components.
Figure 5B:
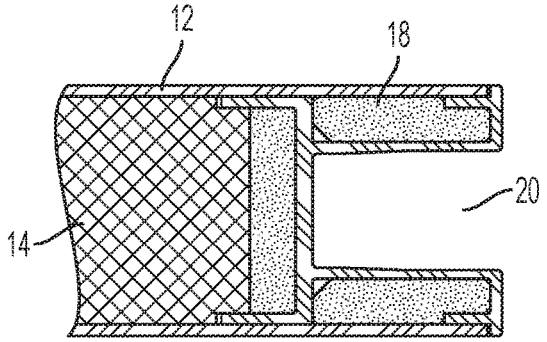
FIG. 5B shows an edge profile with an additional drop-in MGO component.
Figure 5C:
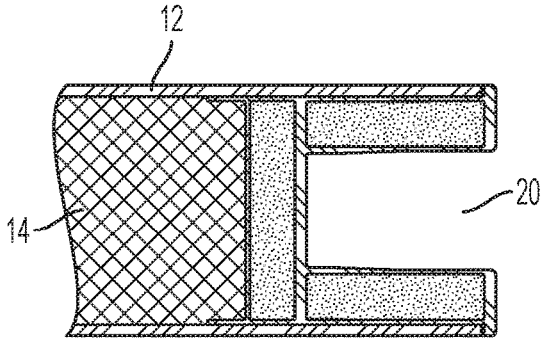
FIG. 5C an edge profile with co-molded MGO components.
Figure 5D:
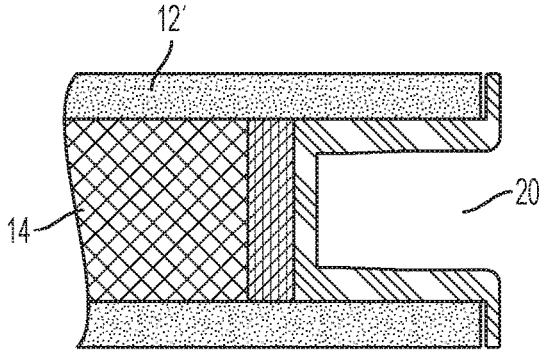
FIG. 5D shows the edge profile of a panel having MGO facing.
Figure 5E:
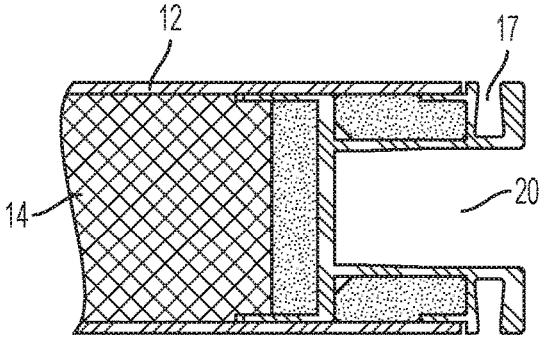
FIG. 5E shows an edge profile with an integral weatherstripping groove.

FIG. 4 shows an exploded view of a wall panel to explain its manufacture. At the factory two pultruded FG skins 12 are placed on either side of a precut slab of mineral wool 14. Correctly sized (with mitered corners) of the panel frame pultrusion 16 are assembled with pre-cut MGO edge pieces 18. Each assembled panel frame is treated with adhesive and inserted into one of the open edges where it interacts with the FG skins 12 as shown in FIG. 3. FIG. 5 shows cross sections of several alternative complete assembled panel frames 19. FIG. 5A shows the same panel frame as shown in FIG. 3; FIG. 5B shows a similar structure including an additional piece of MGO 18. FIG. 5C shows an assembly that appears similar to that of FIG. 5B except that the three MGO pieces 18 are co-molded with the pultruded FG as opposed to being added afterwards. FIG. 5D is an alternate embodiment where the entire panel has MGO skins 12' instead of pultruded FG skins 12. FIG. 5E is a structure similar to that of FIG. 5B except it also has grooves 17 to accept a weather stripping shield (not shown) that protects the joint between adjacent panels.

Figure 6:
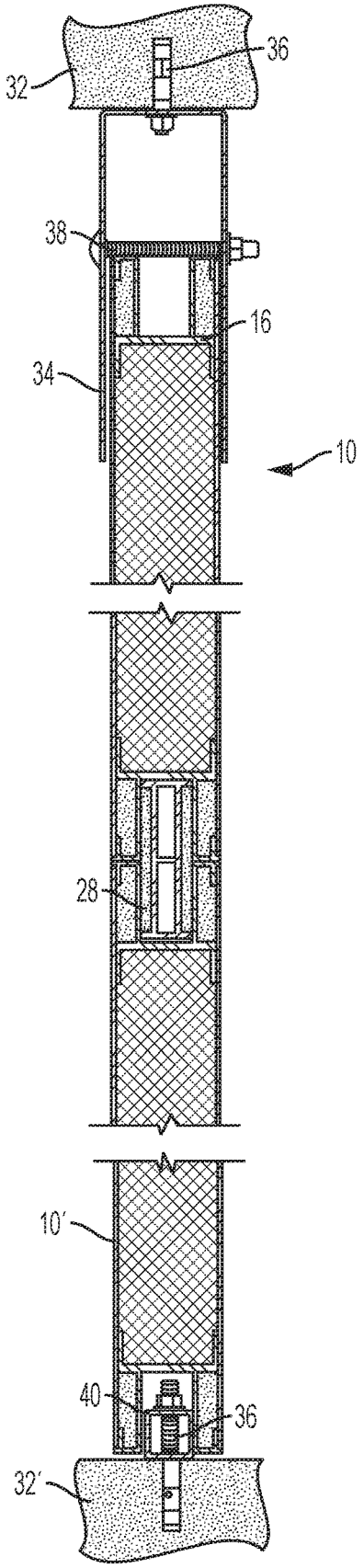
FIG. 6 shows a diagrammatic cross section through one column of the invention showing its interaction with the base track and the top track.

FIG. 6 shows a cross-section through an assembled temporary wall with the section normal to the floor. A spline 28 is seen joining two panels 10. At the top of the drawing an existing platform 32 (one of the concrete platforms that forms the divides the stories of a building serving as the floor for the story above and the ceiling of the story below). A top track 34 is fastened to the platform 32 by a removable anchor bolt 36. The top track 34 has a generally "C" shaped profile with its mouth facing down. A panel 10 is grasped by the top track 34 as will be explained in more detail below. The panel frame 16 including the spline cavity is inserted into the opening of the top track 34, and clamped tight by the clamping bolt 38. The lower panel frame 16 of the lower panel 10' rests on the lower platform 32' that forms the floor. The lower panel 10' is positioned and held in place by a base track 40 which is sized to fit within the spline cavity 20. The base track 40 is attached to the lower platform 32' by an anchor bolt 36 which extends into the open space of the spline cavity 20.

Figure 8:
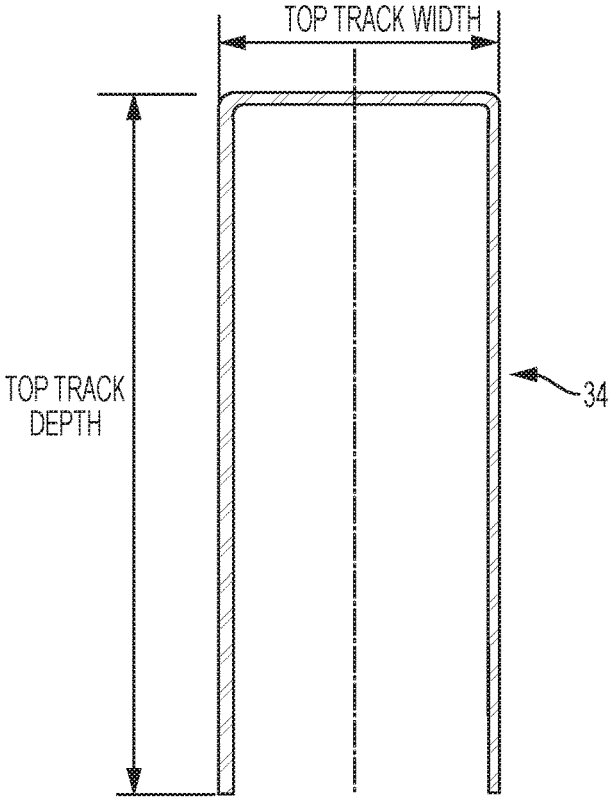
FIG. 8 shows a diagrammatic cross-section of the top track.

FIG. 7 shows some further details of the top track 34. FIG. 7A-1 is a view looking up into a top track 34 to show the typical spacing of the holes 37 for the anchor bolts 36. FIG. 7B-2 is a view of the sides of the top track 34 showing the slot 39 in which the clamping bolts 38 will be inserted. The slots allow the clamping bolts 38 to always be inserted above the tip edge of the panels even if there is a variation in panel height. The slots are typically about 4 inches (10.16 cm) in length. FIG. 8 shows a cross-section through a top track 34. The top track 34 is typically about 3 inches (7.62 cm) in width and about 9 inches (22.86 cm) in height. These dimension are related to the panel dimensions and would be different if different panel dimensions are used.

Figure 9A:
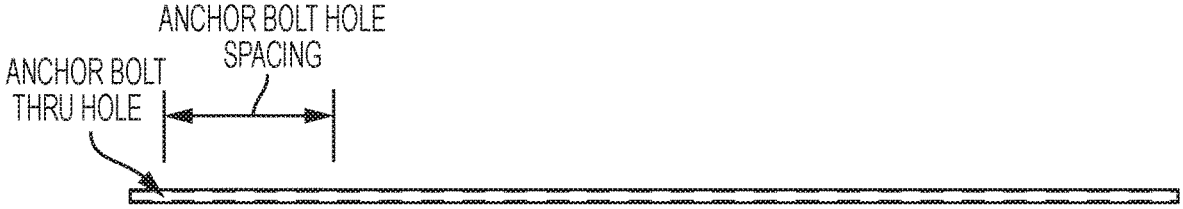
FIG. 9A shows a view of the top surface of the bottom track and FIG. 9B shows a side view of the bottom track.
Figure 9B:
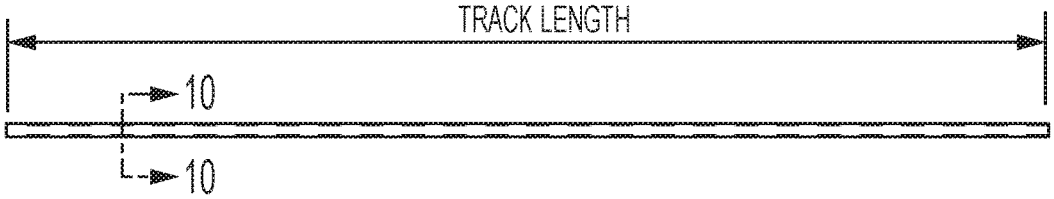
Figure 10:
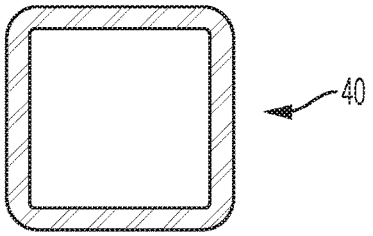
FIG. 10 shows a diagrammatic cross-section through the base track.

FIG. 9A shows a view of the base track 40 from above to show the typical spacing of holes for the anchor bolts 36, and FIG. 9B is a side view of the base track 40. As shown in cross-section (FIG. 10) the base track has a square profile and is about 1.25 inches (3.175 cm) on each side. The base detail is compatible with industry standard wall/roof flashing details.

Figure 11A:
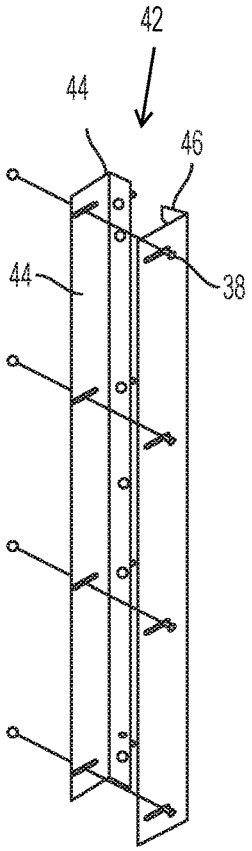
FIG. 11A shows the two component that make up the end wall track.
Figure 11B:
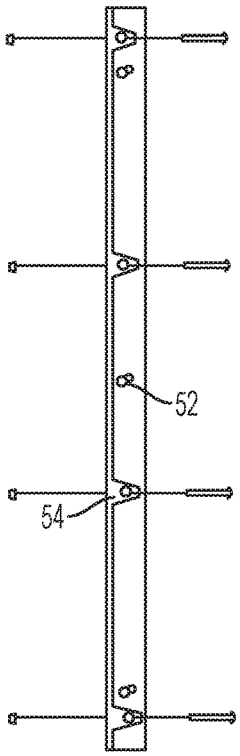
FIG. 11B shows the free component of the end track.
Figure 11C:
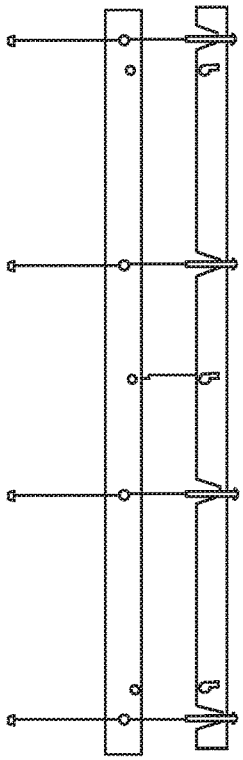
FIG. 11C shows the relationship between the free and fixed components and FIG. 11D shows the two components assembled.
Figure 11D:
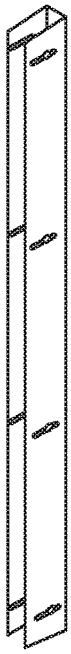
Figure 12:
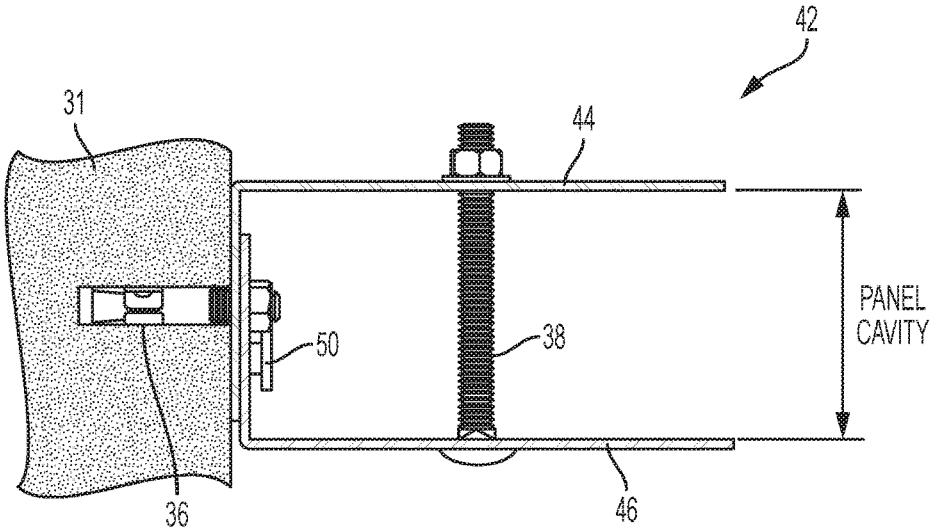
FIG. 12 shows a diagrammatic cross section through an assembled end wall track.

Just as the upper edges to the panels are inserted into a top track 34, the side edges of a panel adjacent to a permanent structural wall 31 are inserted into an end wall track 42 that is attached to the permanent structural wall 31. FIG. 11A shows that the end wall track 42 actually consists of two components, an end wall anchor piece 44 and an end wall adjustment piece 46. The anchor piece 44 has anchor bolt holes 48 for attachment to the permanent structural wall 31, and alignment studs 50 for alignment of the adjustment piece 46. The alignment piece 46 (FIG. 11B) has alignment holes 52 for interacting with the alignment studs 50 and clearance notches 54 to clear the anchor bolts 36 when they are inserted in the anchor bolt holes 48. FIG. 11C shows the two components aligned side by side to show the positional relationship of the alignment studs 50 and the alignment holes 52. FIG. 11D is a perspective view of the assembled components. Note that both the anchor piece 44 and the adjustment piece 46 have clamping slots 56 for accepting clamping bolts 38. FIG. 12 shows a cross-section of the two pieces assembled to form an end wall track 42; an anchor bolt 36 attaching the structure to the permanent wall 31 and a clamping bolt 38 for securing a panel 10 when one is inserted. It will be appreciated that the clamping action is essentially identical to that of the top track 34 explained above. It will also be appreciated that the reason for the separate adjustment piece 46 is to allow a panel to be assembled onto a temporary wall with tight clearance to a permanent structural wall 31. In such a situation the anchor piece 44 is attached to the permanent wall 31, the final panel is added to the temporary wall so that is side overlaps the anchor piece 44; then the adjustment piece is attached overlapping the panel edge and the clamping bolts 38 are inserted and tightened to secure the panel edge.

Figure 13:
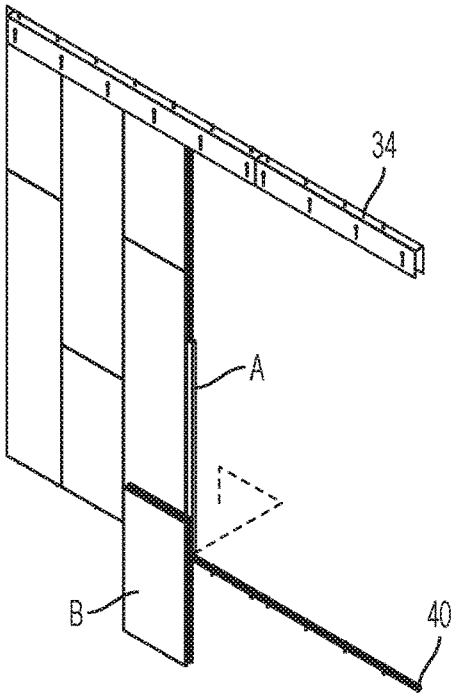
FIG. 13 shows a view of a partially erected wall with several complete panel columns illustrating staggered horizontal joints between adjacent panels.

FIG. 13 shows a section of temporary wall that is being assembled between a top track 34 and a bottom track 40. Two panels 10 are needed to span between the top track 34 and the bottom track 40. Each assembled vertical span of panels is considered a column. Note that the horizontal junctions between the panels of adjacent columns are staggered to improve the lateral strength of the temporary wall. The panels 10 are manufactured in a number of different sizes (see Table I). This allows ready accommodation of platform (floor to ceiling measurement) spacing of between 12 feet (365.76 cm) and 16 feet (487.68 cm) (which covers virtually all of the common platform spacing dimensions) with no cutting of panels because of the adjustability of the top track 34. Currently, all of the panels have a width of 24 inches (60.96 cm) although other widths could readily be produced. Providing a single width means that at most, one panel column will need lateral cutting to accommodate any wall length.

Figure 14:
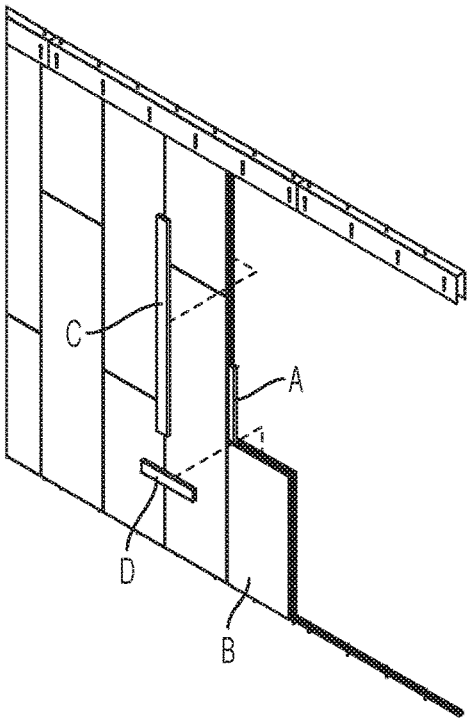
FIG. 14 shows the wall of FIG. 13 wherein an additional column is being assembled.
Figure 15:
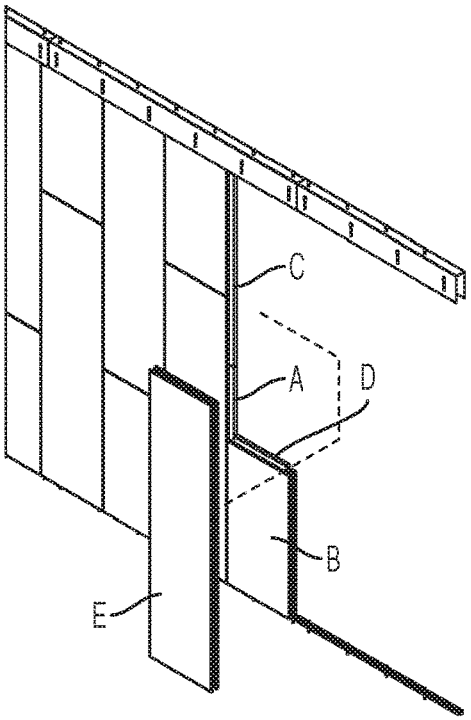
FIG. 15 shows the wall of FIG. 14 illustrating the next step in assembling the new column.
Figure 16:
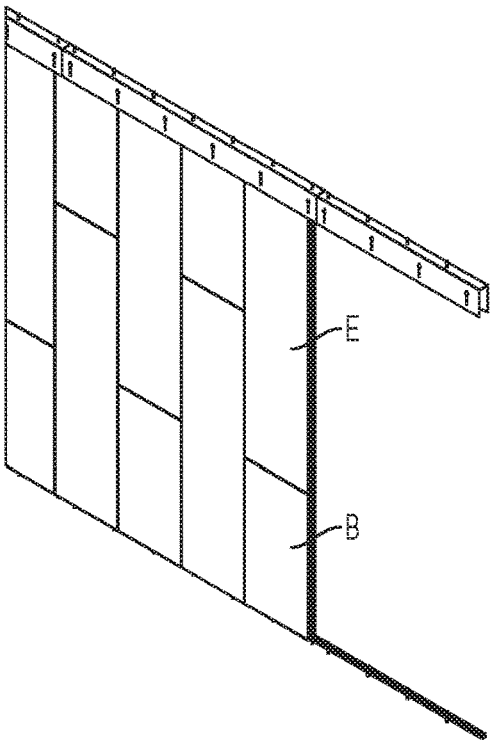
FIG. 16 shows the wall of FIG. 15 with the new column completed.

In FIG. 13 one spline A has already been inserted onto the right side of the rightmost column of wall panels. A short panel B is shown in front of the wall waiting to be inserted. In FIG. 14 panel B has been placed over the bottom track 40 and slid into tight contact with spline A so that it is locked into the growing column. Splines C and D are then inserted into position. FIG. 15 shows splines C and D locked into position with panel E positioned to be inserted into the growing column. Note that like the horizontal panel joints, the horizontal joints between splines are also staggered so as to not coincide with one of the horizontal panel joints. Finally in FIG. 16 panel E has been locked into position, thereby completing the column. This is achieved by lifting panel E so that its edges are inserted in the top track 34. Then the panel is moved laterally to interact with splines C and D.

TABLE I

| Panel Dimensions | |
|---|---|
| Width | Height |
| 24 inches (60.96 cm) | 4.5 inches (11.43 cm) |
| 24 inches (60.96 cm) | 9.0 inches (22.86 cm) |
| 24.0 inches (60.96 cm) | 12.0 inches (30.38 cm) |
| 24.0 inches (60.96 cm) | 36.0 inches (91.44 cm) |
| 24.0 inches (60.96 cm) | 48.0 inches (121.92 cm) |
| 24.0 inches (60.96 cm) | 60.0 inches (152.4 cm) |
| 24.0 inches (60.96 cm) | 72.0 inches (182.88 cm) |
| 24.0 inches (60.96 cm) | 96.0 inches (243.84 cm) |

Figure 17:
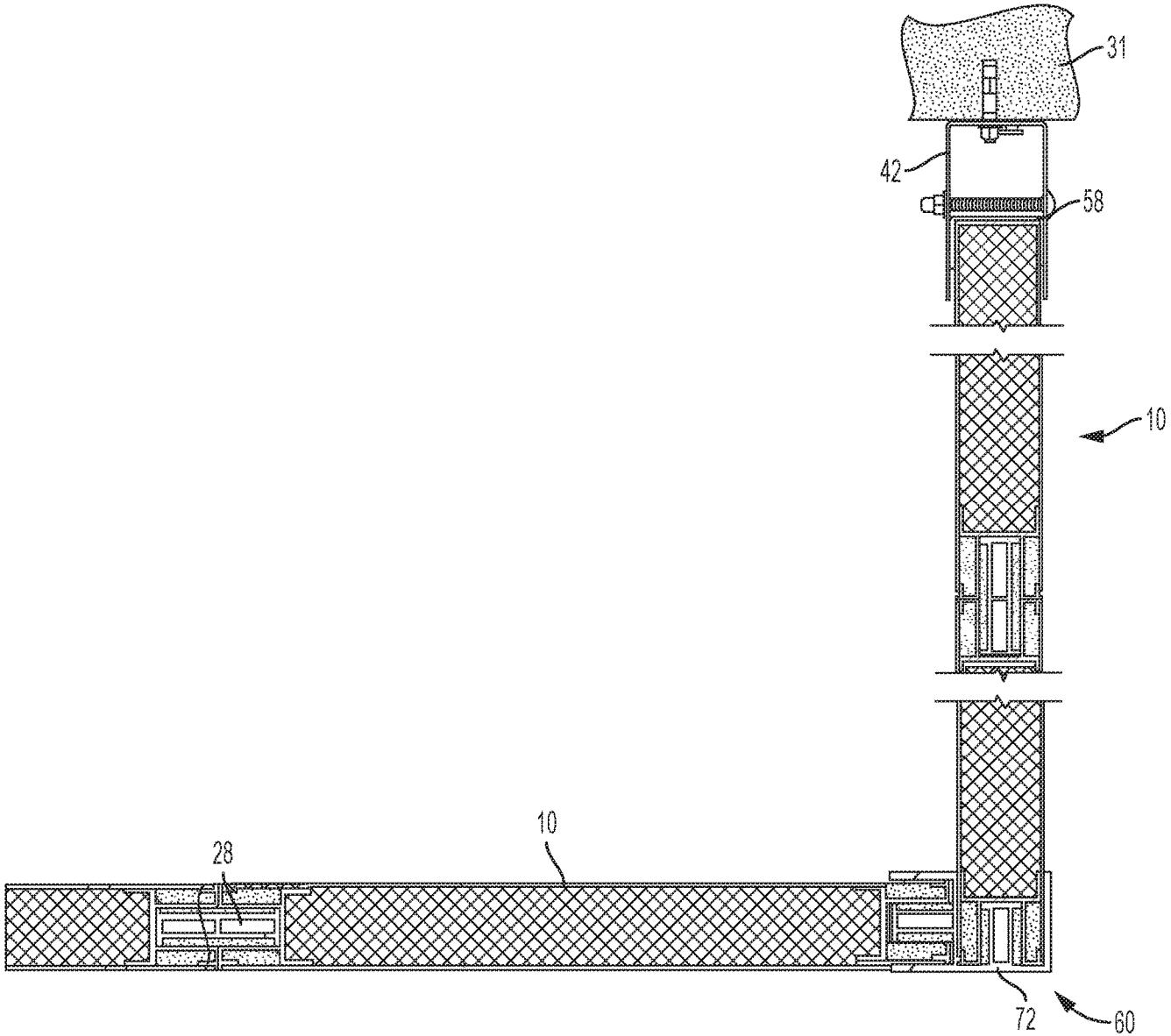
FIG. 17 shows a diagrammatic cross section (taken parallel to the floor) of a wall section with a fixed corner column.

FIG. 17 shows a cross-section through a temporary wall of the present invention taken parallel to the floor. At the upper end of the drawing the edge of a wall panel is inserted into an end wall track 42. Note that the inserted panel does not show the typical panel frame 16 with a spline cavity 20. Rather this panel is capped with and extrusion similar in shape to the end wall track 42 itself. This is a field cut frame 58 that is used to seal the edge of a panel that has been cut to a special dimension. As mentioned above (Table I), the panels come in a variety of sizes making it relatively easy to accommodate a wide variety of wall sizes. However, it is sometimes necessary to cut a panel to achieve a particular dimension. The panel can be readily cut with ordinary saws. Then an appropriate length of field cut frame 58 is glued to the panel to seal the cut opening, thereby restoring panel properties because the field cut frame 58 is made from the same pultruded fire-resistant FG as the panel skin 12 and regular panel frame 16. Gluing the field cut frame 58 over the cut edge slightly increases the panel thickness, but the clamping bolt 38 of the end wall track 42 can easily accommodate this.

Figure 19:
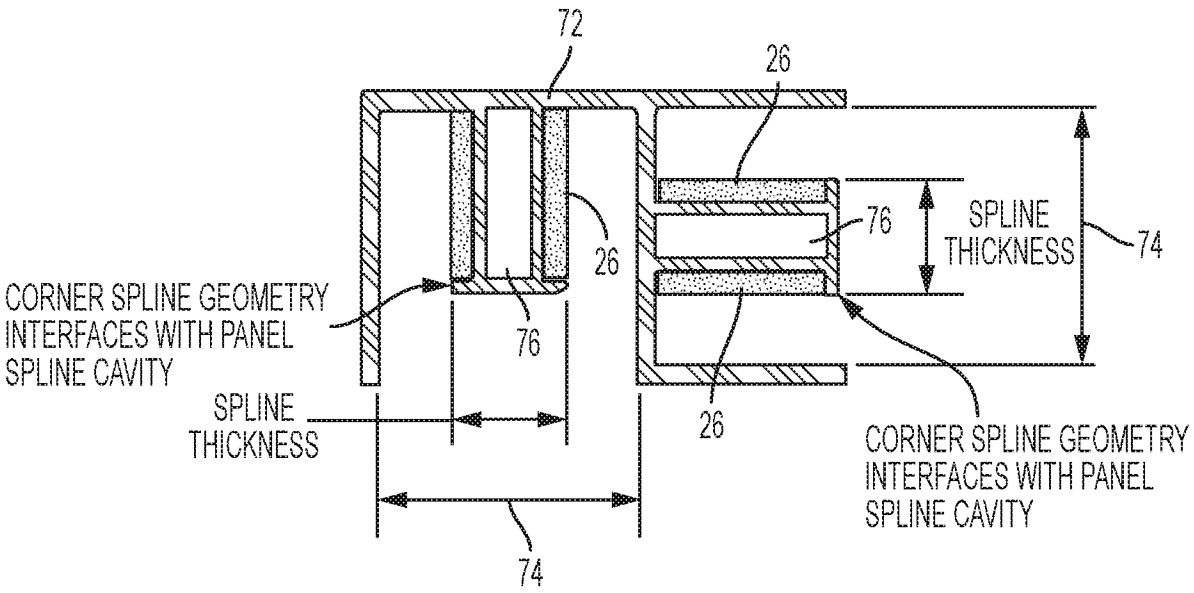
FIG. 19 shows a diagrammatic cross-section through a fixed corner column.
Figure 18:
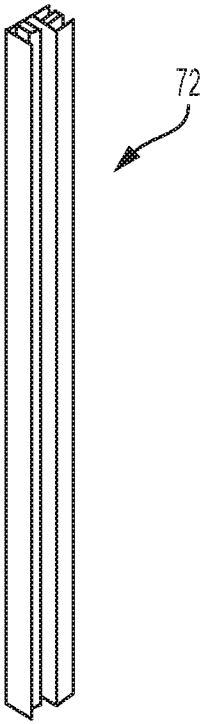
FIG. 18 shows a perspective view of a fixed corner column.

The wall in FIG. 17 has a corner 60 created by the use of a fixed corner column 72. The fixed corner column 72 has two cavities sized to accept a panel frame 16 with spline cavity 20. Where the two temporary walls are assembled by starting at the corner, it is possible to use a fixed corner column 72 which is shown in a perspective view in FIG. 18. In this device neither of the cavities are clamping cavities. FIG. 19 is a cross section which shows that the two corner cavities 74 are formed from pultruded FG and each contain a spline mimic 76 which are integrally formed with the rest of the extrusion; the spline mimic 76 is complete with replaceable MGO faces 26 so that a panel 10 inserted into either of these cavities will be held as if it had been attached to an adjacent panel with an FG spline 28.

Figure 20A:
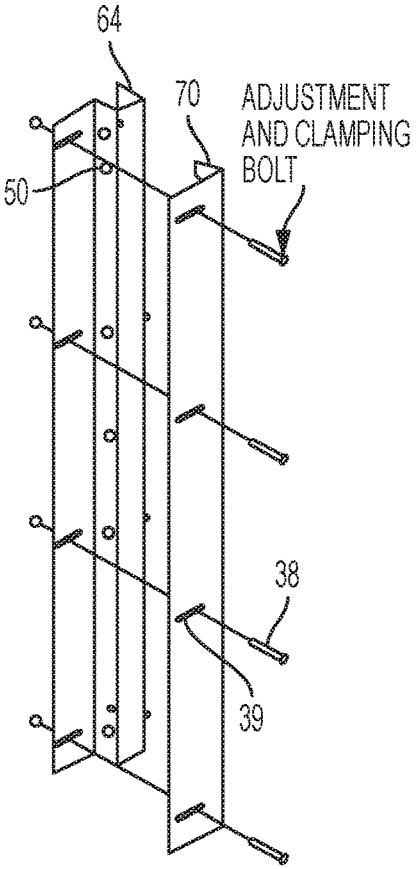
FIG. 20A shows the fixed and free components in relation to each other and FIG. 20B shows the free component of the adjustable corner column assembly.
Figure 20B:
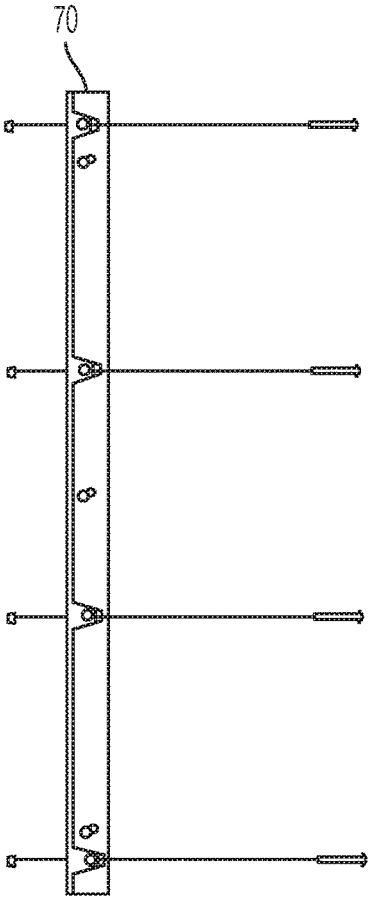
Figure 21:
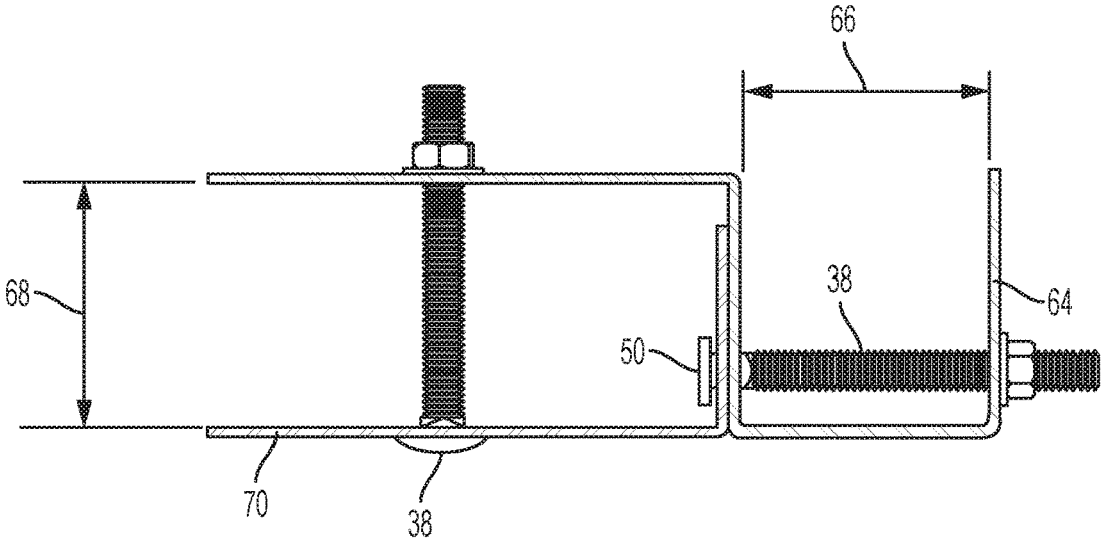
FIG. 21 shows a diagrammatic cross section through an assembled adjustable corner column assembly.

FIG. 20A shows that the adjustable corner column is analogous to the adjustable end wall track 42. One of the two clamping cavities is formed from a corner column track 64 which bears the second clamping cavity 66 oriented at a right angle. The first clamping cavity 68 is formed by the interaction of the corner column track 64 and an adjustment track 70 (FIG. 20B) which interacts with the corner column track 64 by means of alignment studs 50 and alignment stud holes 52. FIG. 21 shows a cross-section of an assembled adjustment corner column 62. The adjustable corner column 62 is used where one of the walls must be assembled towards the corner and the final panel can only be accommodated by assembling the adjustable corner column 62 after the panel is in place.

Figure 22:
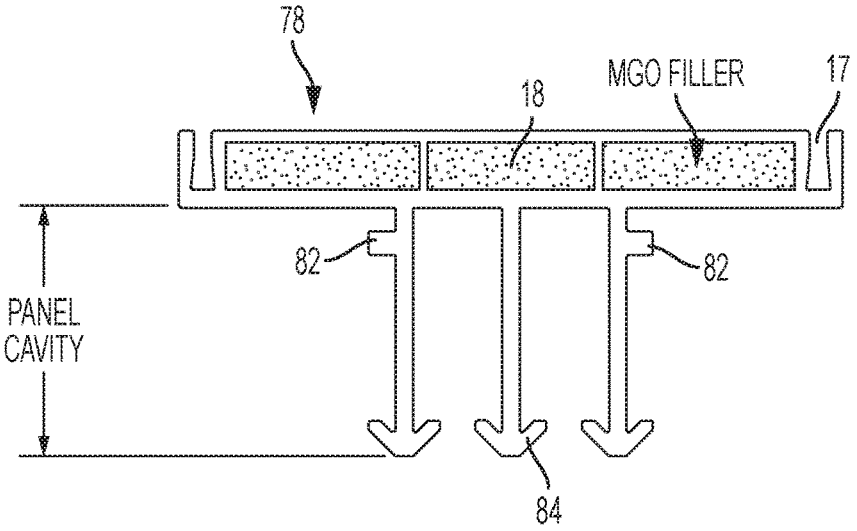
FIG. 22 show a cross-section of the panel joint column component of FIG. 23.
Figure 23:
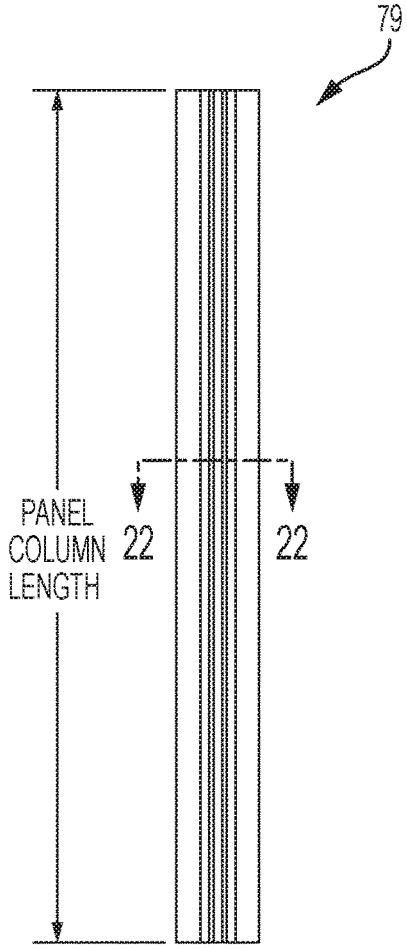
FIG. 23 shows an elevational view of an alternative panel joint column component.
Figure 24:
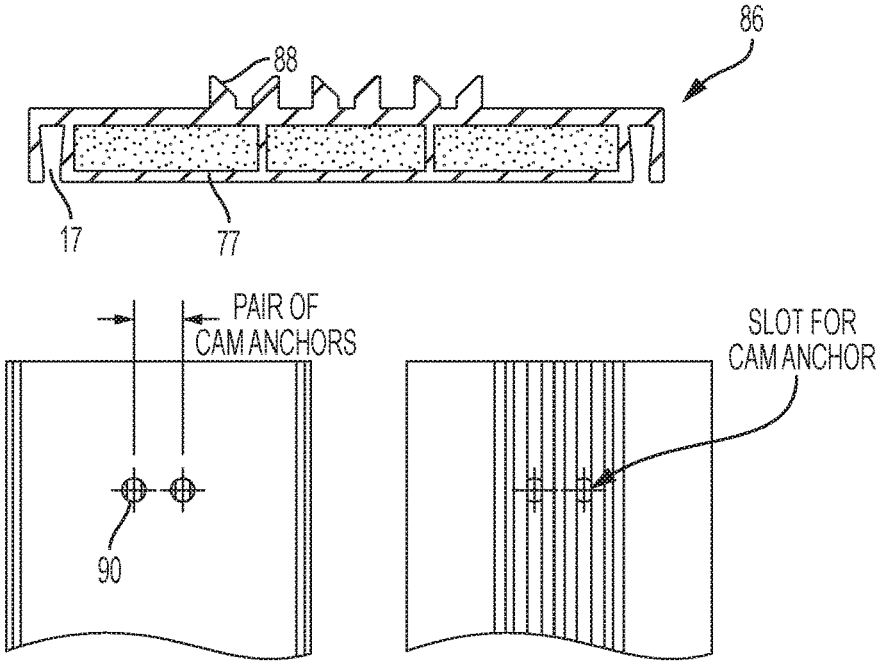
FIG. 24 shows an elevation view of an alternative panel joint column component that interfaces with the panel joint column component of FIG. 23.
Figure 25:
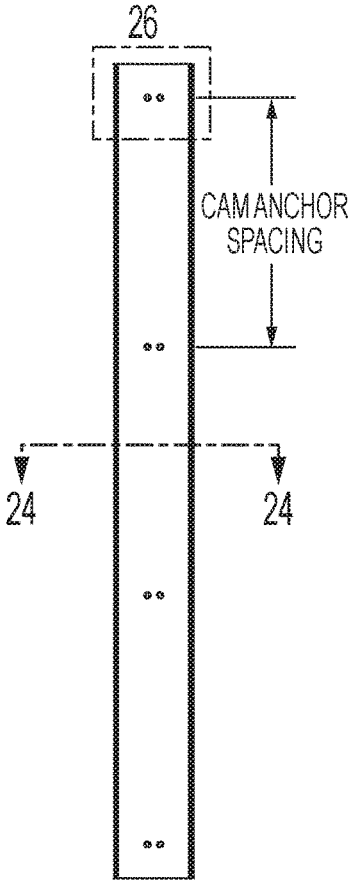
FIG. 25 show a cross-section of the panel joint column component of FIG. 24.

In some situations it is desirable to add enhanced lateral strength to a temporary wall. For this purpose and ordinary column of wall panels can be replaced with a special panel joint column the face 79 of which is shown in FIG. 23. This column is only about 6 inches in (15.24 cm) width so that inserting four of them (spaced apart) into a wall would take up the space occupied by one column of ordinary panels. A cross-section of the first component 78 of this panel joint is shown in FIG. 22. Like the panel frames 16 of the ordinary panel 10 it contains MGO filler pieces 77. It also has weather-stripping grooves 17. This component also has two panel stops 82 and male panel joint mating surfaces 84 which mate with female mating surfaces 88 on the second component 86 (FIG. 25) of the special panel joint. The second component 86 has MGO insets 77 and weather-stripping 17. The outside face of this component is shown in FIG. 24. Note the cam anchor holes 90.

Figure 26:
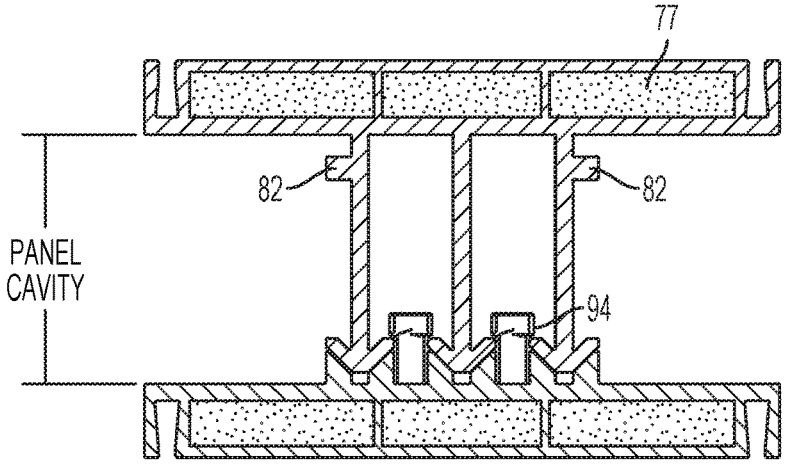
FIG. 26 Show a cross-section of the components of FIG. 22 and FIG. 25 assembled together.
Figure 27:
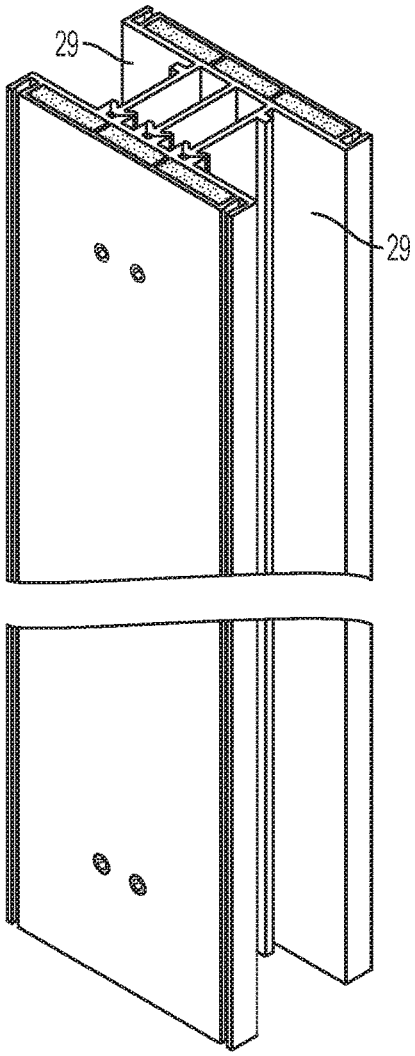
FIG. 27 shows a perspective view of the assembly of FIG. 26.
Figure 28:
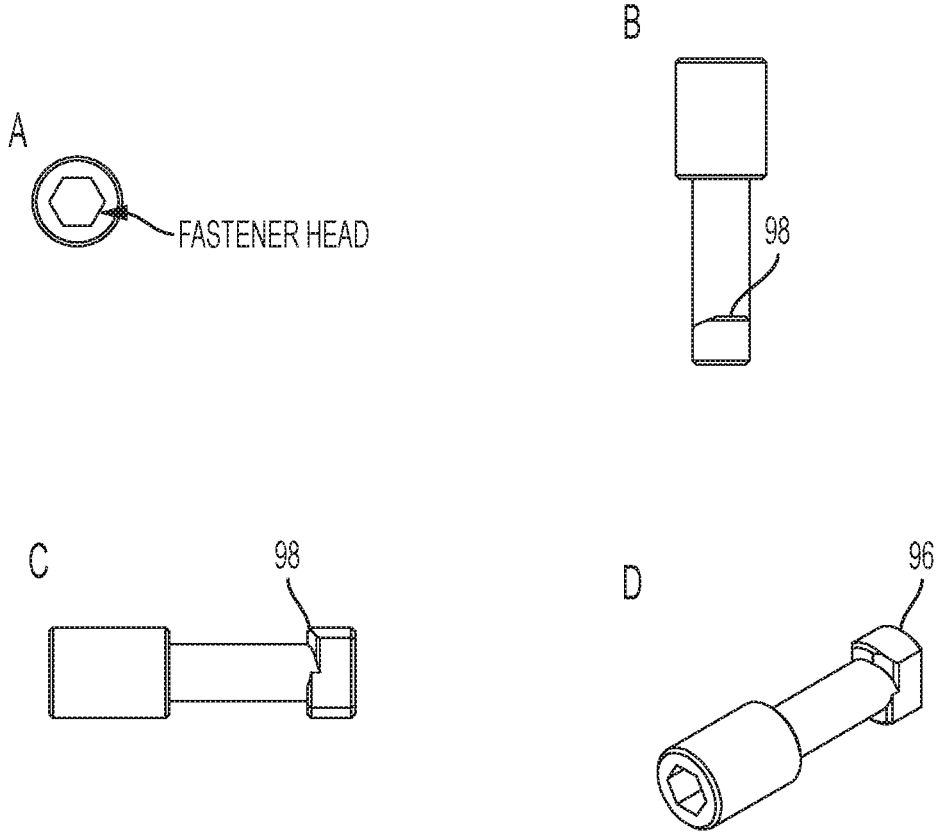
FIG. 28 shows views of a locking cam used in the assembly of FIG. 31.

FIG. 26 shows the two components assembled to form a special joint column 92 which is shown in perspective in FIG. 27. When the two components 78, 86 are assembled they form two panel cavities 29 into which the edges of the panels are inserted. The inserted panels are stopped by the panel stops 82. FIG. 26 also shows how the locking cams 94 are inserted through the cam holes 90 and interact with the edges of the male mating surfaces 84 to lock the two components together. FIG. 28 shows various view of the locking cams 94 to better understand there function. FIG. 28D shows the cam in a perspective view. The cam 94 is inserted through the cam holes 90 with the square locking end 96 first. The round adjustment head 98 (see also FIG. 28A for a head-on view). The rectangular locking head 96 just fits through a slot between the male mating surfaces 84. When an alien wrench is used to rotate the cam 64, the shoulders 98 lock onto the male mating surfaces 84. This provides a very strong structure that can be readily disassembled at the end of the construction.

Figure 29:
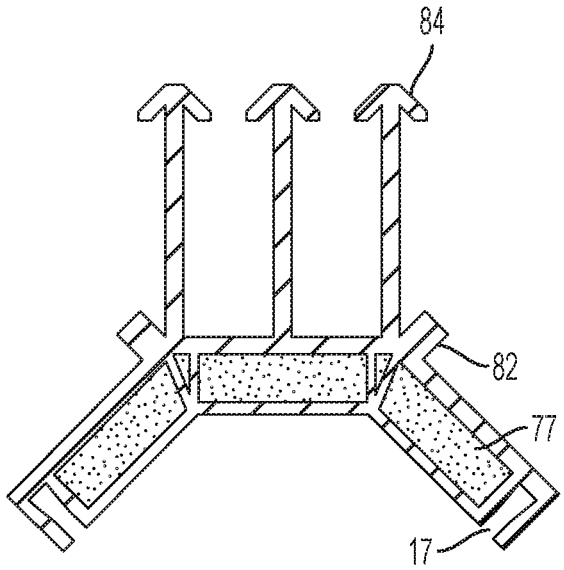
FIG. 29 shows the cross-section of an alternative column corner component which is analogous to the design of the component of FIG. 22.
Figure 30:
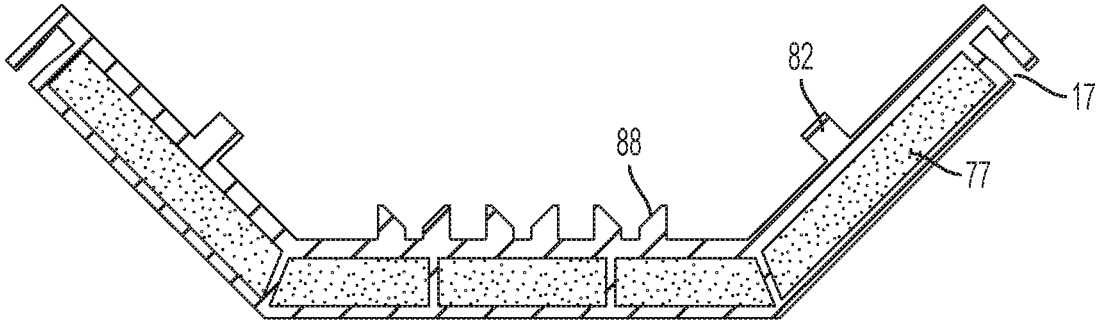
FIG. 30 shows a cross-section of a second of alternative column corner component designed to interface with the component of FIG. 29.
Figure 31:
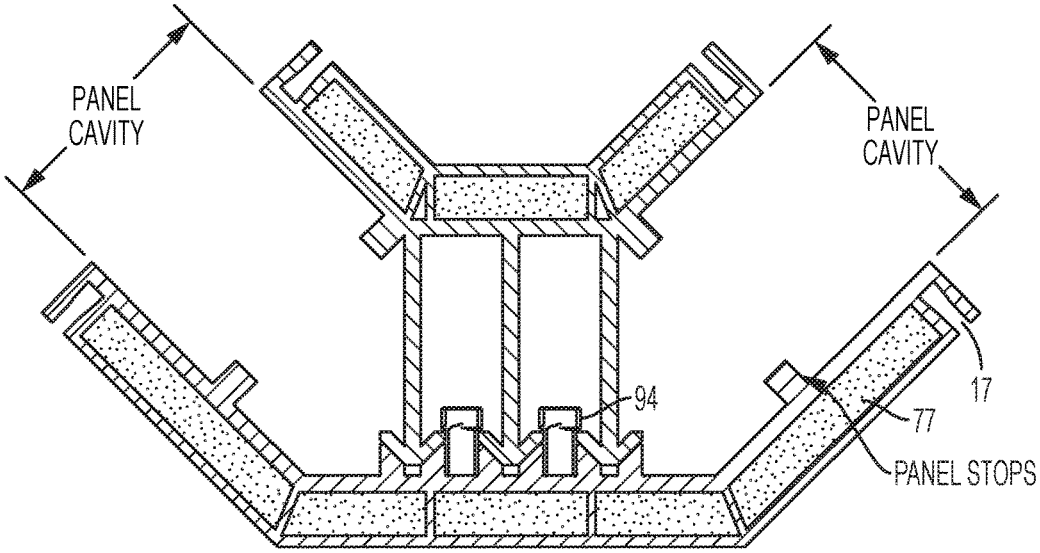
FIG. 31 shows a cross-section of the components of FIG. 29 and FIG. 30 assembled.
Figure 32:
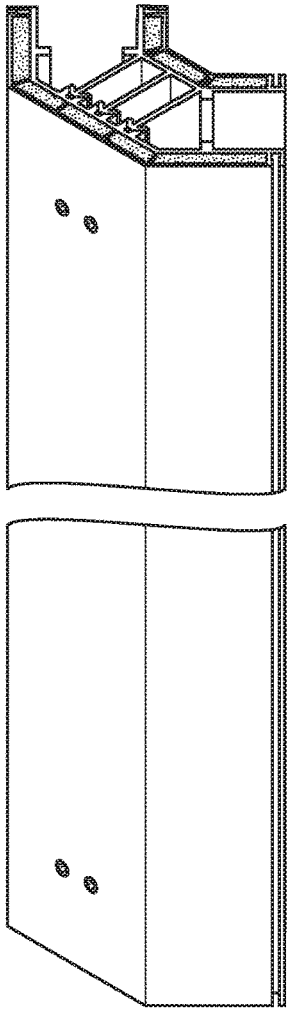
FIG. 32 shows a perspective view of the assembly of FIG. 31.

FIGS. 29 and 30 show special panel joint column components that are configured to form a corner. The assembled structure is shown in cross section in FIG. 31 and in perspective in FIG. 32. It functions just like the straight special panel joint column.

Figure 33:
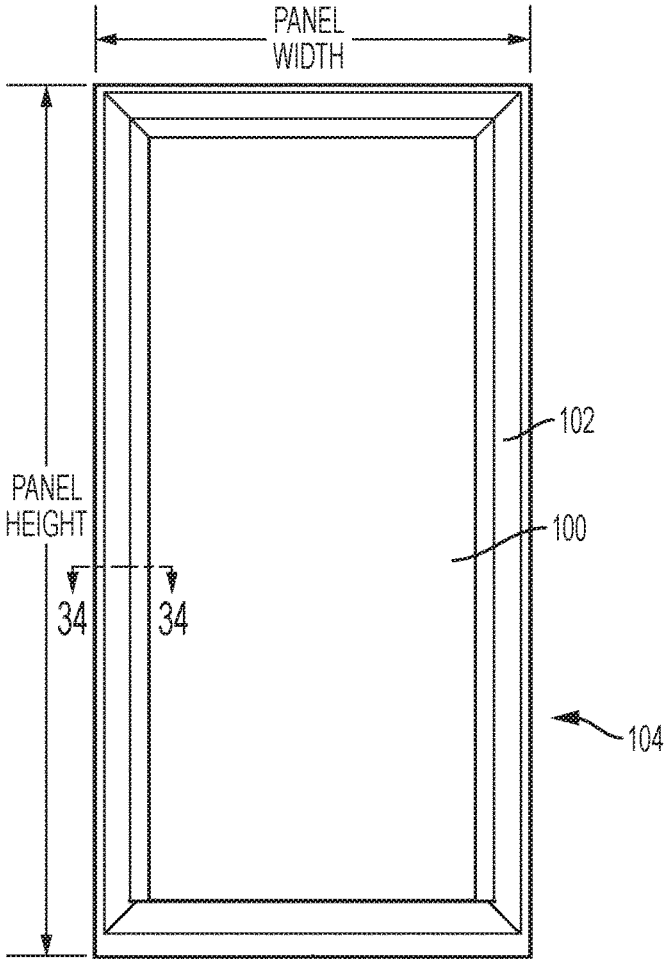
FIG. 33 show a diagrammatic view of a door designed to insert into the inventive temporary wall'
Figure 34:
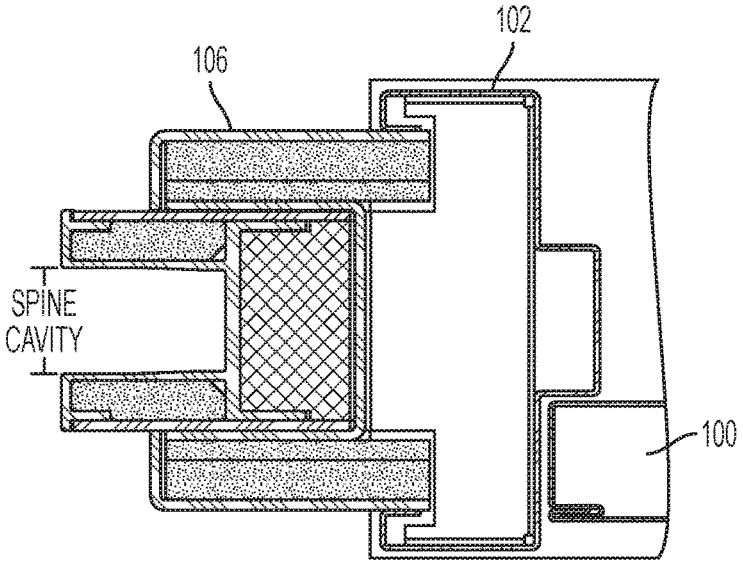
FIG. 34 shows a cross-section of the frame of the door of FIG. 33 showing how it interfaces with the panels.

FIG. 33 shows a typical fire rated commercial metal door 100 and frame 102 that is adapted to use with the temporary wall of the current invention. The manufactured door panel including modified frame fit within a custom panel 104 that is the equivalent width of two typical panels (that is two times 24 inches [121.92 cm] which is 48 inches [243.84 cm]). The door including modified frame is selected to have one of the standard panel heights. As shown in FIG. 34 lateral jams and head and sill of the door assembly has a special FG cap 106 including MGO inserts 18 added so that it has a spline cavity 20 and will accept a spline 28 and mate with adjacent panels.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A reusable, temporary construction wall comprising:

a top track attachable to a lower surface of a building platform that defines a ceiling of an area;

a bottom track attachable to an upper surface of a building platform that defines a floor of the area, the top track and the bottom track disposed in vertical registration when attached to their respective building platforms;

wall panels comprised of:

a rectangular thickness of material sandwiched between fire resistant skins; and panel frames having a spline cavity, the frames closing the top edges, the bottom edges and the lateral edges of the panels wherein the spline cavity has a width, a thickness and a length; and splines having thicknesses that allow friction fit into the spline cavity and widths equal to twice the width of a spline cavity whereby insertion into the spline cavities of the top edges of panels allows assembly of a vertical column of panels which spans from the bottom track to the top track and insertion into the spline cavities of lateral edges of the column of panels allows assembly of an additional vertical column of panels alongside the vertical column of panels so that an entire temporary wall spanning a length of the top track can be assembled.

2. The reusable, temporary construction wall of claim 1 further comprising an end wall track attachable to a permanent building wall and accepting the lateral edges of the temporary wall thereby fixing the temporary wall to the permanent building wall.

3. The reusable, temporary construction wall of claim 1 further comprising a corner column for introducing a corner into the temporary wall.

4. The reusable, temporary construction wall of claim 3, wherein the corner column is a fixed corner column bearing two cavities sized to accept the lateral edges of a vertical column of panels, the two cavities oriented at right angles to each other with each cavity bearing a member having a thickness to allow friction fit into the spline cavity to hold panel edges upon insertion.

5. The reusable, temporary construction wall of claim 3, wherein the corner column is an adjustable corner column bearing two cavities sized to accept the lateral edges of a vertical column of panels, the two cavities oriented at right angles to each other with each cavity bearing clamping bolts to clamp panel edges after insertion.

6. The reusable, temporary construction wall of claim 3, wherein the corner column is joint corner column bearing two cavities sized to accept the lateral edges of a vertical column of panels, the two cavities oriented at right angles to each other, wherein the joint corner column is assembled from two components, a first component having a male mating shape and second component having a female mating shape and wherein the two components are fixed together by locking cams after assembly.

7. The reusable, temporary construction wall of claim 1 further comprising a panel joint column for strengthening the temporary wall, the panel joint column bearing two cavities sized to accept the lateral edges of a vertical column of panels wherein the panel joint column is assembled from two components, a first component having a male mating shape and second component having a female mating shape and wherein the two components are fixed together by locking cams after assembly.

8. A method for forming a reusable, temporary construction wall comprising the steps of:

attaching a top track to a lower surface of a building platform that defines a ceiling of an area;

attaching a bottom track to an upper surface of a building platform that defines a floor of the area with the top track and the bottom track disposed in vertical registration;

providing wall panels comprised of:

a rectangular thickness of material sandwiched between fire resistant skins; and panel frames having a spline cavity, the frames closing the top edges, the bottom edges and the lateral edges of the panels wherein the spline cavity has a width, a thickness and a length;

providing splines having thicknesses that allow friction fit into the spline cavity and widths equal to twice the width of a spline cavity;

inserting splines into the spline cavities of the top edges of panels;

assembling a vertical column of panels which spans from the bottom track to the top track;

inserting splines with friction fit into the spline cavities of the lateral edges of the vertical column;

assembling of an additional vertical column of panels which spans from the bottom track to the top track; and repeating these steps to assemble a temporary wall spanning a length of the top track.

9. The method for forming a reusable, temporary construction wall of claim 8 further comprising the step of using a corner column to introduce a corner into the temporary wall.

10. The method for forming a reusable, temporary construction wall of claim 9, wherein the corner column is a fixed corner column bearing two cavities sized to accept the lateral edges of a vertical column of panels, the two cavities oriented at right angles to each other with each cavity bearing a spline-sized member to hold panel edges upon insertion.

11. The method for forming a reusable, temporary construction wall of claim 9, wherein the corner column is an adjustable corner column bearing two cavities sized to accept the lateral edges of a vertical column of panels, the two cavities oriented at right angles to each other with each cavity bearing clamping bolts to clamp panel edges after insertion.

12. The method for forming a reusable, temporary construction wall of claim 9, wherein the corner column is joint corner column bearing two cavities sized to accept the lateral edges of a vertical column of panels, the two cavities oriented at right angles to each other, wherein the joint corner column is assembled from two components, a first component having a male mating shape and second component having a female mating shape and wherein the two components are fixed together by locking cams after assembly.

13. The method for forming a reusable, temporary construction wall of claim 8 further comprising using a panel joint column for strengthening the temporary wall, the panel joint column bearing two cavities sized to accept the lateral edges of a vertical column of panels wherein the panel joint column is assembled from two components, a first component having a male mating shape and second component having a female mating shape and wherein the two components are fixed together by locking cams after assembly.

* * * * *